US008474998B2

(12) United States Patent
Wang et al.

(10) Patent No.: US 8,474,998 B2
(45) Date of Patent: Jul. 2, 2013

(54) RAIL AND CLIP MOUNTING FOR LED MODULES FOR FLUORESCENT APPLICATION REPLACEMENT

(75) Inventors: Bill (Xin) Wang, ShangHai (CN); Jeffrey Nall, Brecksville, OH (US); Luc Cloutier, Lachine (CA); John Owens, Olmsted Falls, OH (US); Min Zhang, ShangHai (CN); Tyler John Rolfes, Cleveland, OH (US); Adrian Slattery, Westlake, OH (US)

(73) Assignee: GE Lighting Solutions LLC, Cleveland, OH (US)

( * ) Notice: Subject to any disclaimer, the term of this patent is extended or adjusted under 35 U.S.C. 154(b) by 223 days.

(21) Appl. No.: 13/043,023

(22) Filed: Mar. 8, 2011

(65) Prior Publication Data

US 2012/0002418 A1 Jan. 5, 2012

Related U.S. Application Data

(60) Provisional application No. 61/311,611, filed on Mar. 8, 2010.

(51) Int. Cl.
*F21S 4/00* (2006.01)

(52) U.S. Cl.
USPC ..... 362/249.02; 362/217.11; 362/217.12; 362/217.15; 362/217.16

(58) Field of Classification Search
USPC ..... 362/217.11, 217.12, 217.15, 217.16, 362/249.02
See application file for complete search history.

(56) References Cited

U.S. PATENT DOCUMENTS

| | | | | |
|---|---|---|---|---|
| 8,172,097 | B2 * | 5/2012 | Nearman et al. | 211/189 |
| 2002/0126064 | A1 | 9/2002 | Yen | |
| 2008/0244944 | A1 * | 10/2008 | Nall et al. | 40/544 |
| 2009/0073693 | A1 | 3/2009 | Nall et al. | |
| 2009/0086478 | A1 * | 4/2009 | Sanroma et al. | 362/234 |
| 2010/0165627 | A1 * | 7/2010 | Wung et al. | 362/249.02 |
| 2011/0019348 | A1 * | 1/2011 | Kludt et al. | 361/679.01 |

FOREIGN PATENT DOCUMENTS

| | | |
|---|---|---|
| JP | 7-121122 | 5/1995 |

* cited by examiner

*Primary Examiner* — Stephen F Husar
*Assistant Examiner* — James Cranson, Jr.
(74) *Attorney, Agent, or Firm* — Fay Sharpe LLP

(57) ABSTRACT

In accordance with a first exemplary embodiment of the present disclosure, a mounting arrangement for use with an LED power strip module is provided. The mounting arrangement comprises one or more one frames having a first end and a second end, a first holding base configured to mate with the first end and a second holding base configured to mate with the second end, and at least one LED module having a first and second edge and comprising a plurality of LEDs, said LED module being adapted to removably attach to the one or more frames. The first and second holding bases are adapted to secure the one or more frames to an existing raceway structure.

28 Claims, 17 Drawing Sheets

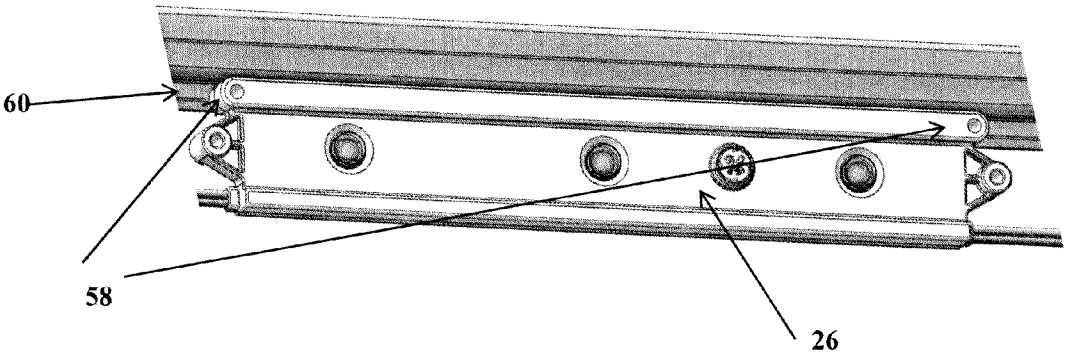
FIGURE 5(a)
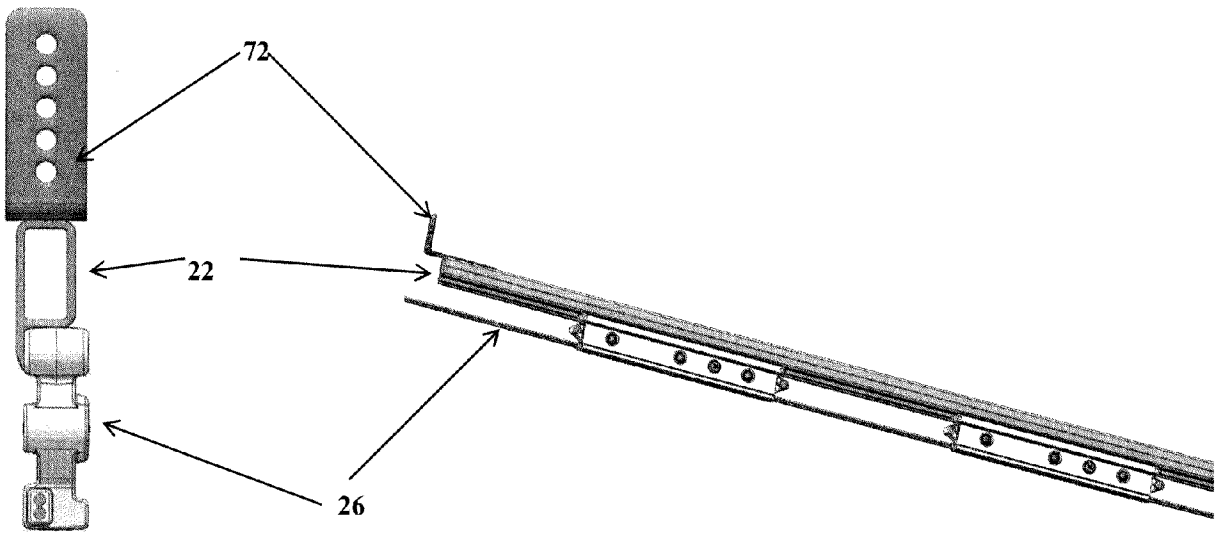
FIGURE 5(b)
FIGURE 5(c)

RAIL AND CLIP MOUNTING FOR LED MODULES FOR FLUORESCENT APPLICATION REPLACEMENT

This application claims priority from provisional application Ser. No. 61/311,611, hereby incorporated by reference in its entirety.

BACKGROUND

The present exemplary embodiment relates to illumination devices, and particularly to a mounting arrangement for illumination devices including light emitting diodes (LED) and will be described with particular reference thereto. However, it is to be appreciated that the present exemplary embodiment is also amenable to other like applications.

Large cabinet signs, which can also be referred to as box signs, use fluorescent bulbs and a ballast as the lighting system. The cabinet signs comprise a housing with translucent panels that define a hollow enclosure. A fluorescent tube and a ballast mount inside the enclosure. The fluorescent tubes evenly illuminate both the front panel and the rear panel, but fluorescent tube lighting has its drawbacks.

Fluorescent lamps are presently much more efficient than incandescent lamps in using energy to create light. Fluorescent tubes emit light in a 360 degree pattern from a central axis. Light that is emitted from the top and bottom portions of the tube is generally wasted and does not reflect well toward the illuminated panels. This decreases the efficiency of the system. Therefore, recently, there has been a trend toward the use of more efficient lighting, in particular, light emitting diodes (LEDs). LEDs consume much less electrical power, are far more reliable, and exhibit much longer lifetimes than fluorescent lamps. As a result, LED replacement modules are being developed to replace linear fluorescent lamps.

Retrofitting cabinet signs has proven to be somewhat problematic, since there is generally no standard size for such signs or for the fluorescent lamps used in the signs, making it difficult to design a LED retrofit lamp that fits and evenly illuminates the space.

Accordingly a solution is desirable to easily retrofit LED modules in sign and cabinet applications for replacement of fluorescent lamps. A solution is further desired to provide an LED configuration that does not create additional layers that block the light from the LEDs and is a simple structure to support the LED modules, mounted from top to bottom or side to side.

SUMMARY OF DISCLOSURE

In accordance with a first exemplary embodiment of the present disclosure, a mounting arrangement for use with an LED power strip module is provided. The mounting arrangement comprises one or more one frames having a first end and a second end, a first holding base configured to mate with the first end and a second holding base configured to mate with the second end, and at least one LED module having a first and second edge and comprising a plurality of LEDs, the LED module being adapted to removably attach to the one or more frames. The first and second holding bases are adapted to secure the one or more frames to an existing raceway structure.

In accordance with another exemplary embodiment of the present disclosure, an LED module is provided. The LED module comprises a housing having a first side edge and a second side edge, a plurality of LEDs mounted on a printed circuit board, and a mounting arrangement. The mounting arrangement comprises at least one frame having a first end and a second end, the frame being adapted to removably accept the LED module, a first holding base configured to mate with the first end, and a second holding base configured to mate with the second end. The first and second holding bases are adapted to secure the one or more frames to an existing raceway structure.

In accordance with another exemplary aspect of the present disclosure, a mounting arrangement for mounting a double-sided LED module to an existing signage application is provided. The arrangement includes one or more transparent flat panels having a cut-out pattern, a plurality of brackets configure to secure the panels to the existing signage application, and at least one double-sided LED module configured to be mounted to the flat panels. The cut-out pattern is configured to allow LEDs to illuminate both sides of the signage application without light blockage.

In accordance with yet another exemplary aspect of the present disclosure, a double-sided LED module for mounting to an existing sign application is provided. The double-sided LED module comprises a housing having a first elongated side edge and a second elongated side edge, and at least one LED mounted on each side of a printed circuit board. The double-sided LED module further includes a mounting arrangement comprising one or more transparent flat panels comprising a cut-out pattern, and a plurality of brackets configured to secure the panels to the signage application having at least two sides. The double-sided LED module is configured to be mounted to the flat panels and the cut out pattern is configured to allow the at least one LED to illuminate each side of the signage application without light blockage.

In accordance with yet another exemplary aspect of the present disclosure, a mounting arrangement for mounting an LED module to sign assembly is provided. The arrangement includes an LED module comprising one or more LEDs positioned on a printed circuit board, a strip clip comprising a front end having jaws configured to open and close, and a back end having radial arms, wherein upon pressure to the aims, the jaws are configured to open and receive the LED module, a folded piece of plastic configured to snap into hooks located on the arms, and a socket capable of receiving the folded piece of plastic.

BRIEF DESCRIPTION OF THE DRAWINGS

FIG. 1(*c*) illustrates an exemplary spring clip for use with the mounting arrangement shown in FIGS. 1(*a*) and (*b*);

FIG. 1(*d*) illustrates an LED module associated with a frame of a mounting arrangement of FIGS. 1(*a*) and (*b*);

FIG. 2(*c*) illustrates a strip clip associated with an LED module and a folded piece of plastic in accordance with another aspect of the present disclosure;

FIG. 2(*d*) illustrates a base associated with the folded piece of plastic shown in FIG. 2(*c*);

FIG. 2(*e*) illustrates an exemplary folded piece of plastic for use with the strip clips and base shown in FIGS. 2(*a*)-(*d*).

FIG. 2(*f*) illustrates an exemplary method of stacking the strip clips of FIG. 2(*c*) for storage and packaging;

FIG. 3(*d*) illustrates an exemplary base for use with the mounting arrangement shown in FIGS. 3(*a*)-(*c*);

FIG. 3(*e*) illustrates an exemplary connector for use with the mounting arrangement shown in FIGS. 3(*a*)-(*c*);

FIGS. 5(*a*)-(*c*) illustrate an exemplary mounting arrangement having a frame and screw tabs for mounting LED modules, in accordance with yet another aspect of the present disclosure;

DETAILED DESCRIPTION

Figure 1B:
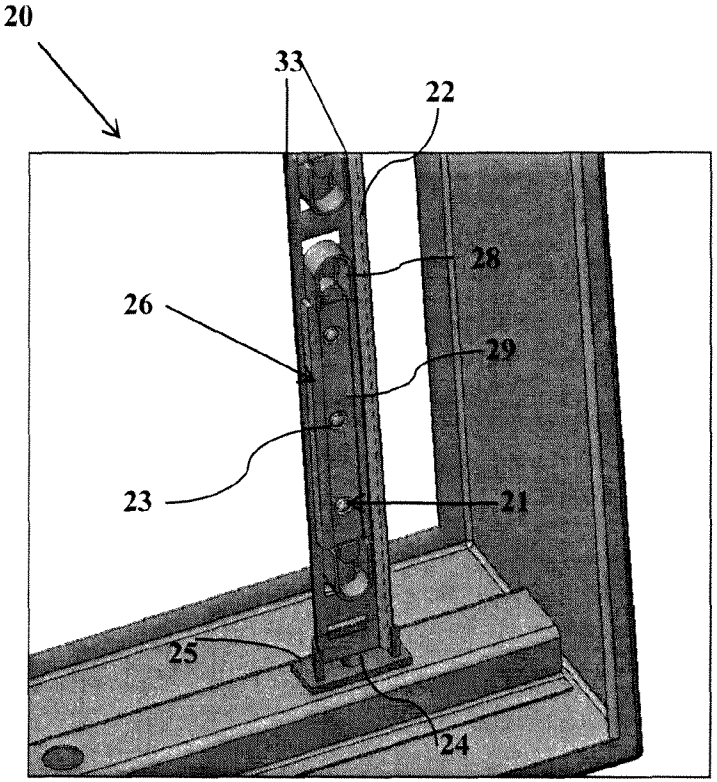
FIGS. 1(*a*) and (*b*) illustrate an exemplary mounting arrangement in accordance with one aspect of the present disclosure.
Figure 1A:
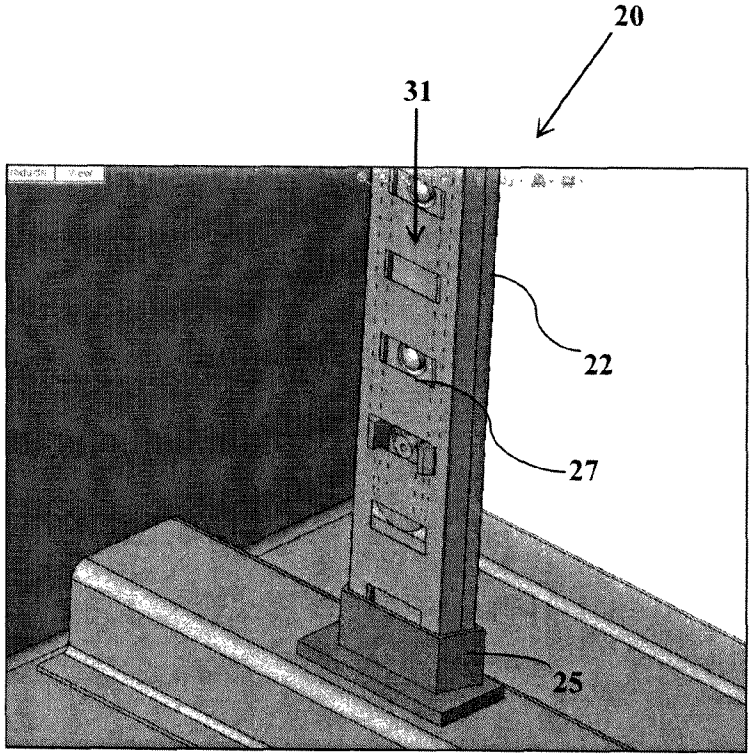
Figure 1C:
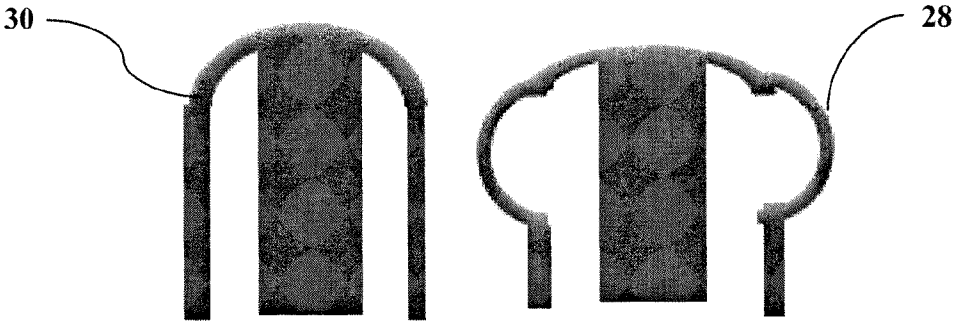
Figure 1D:
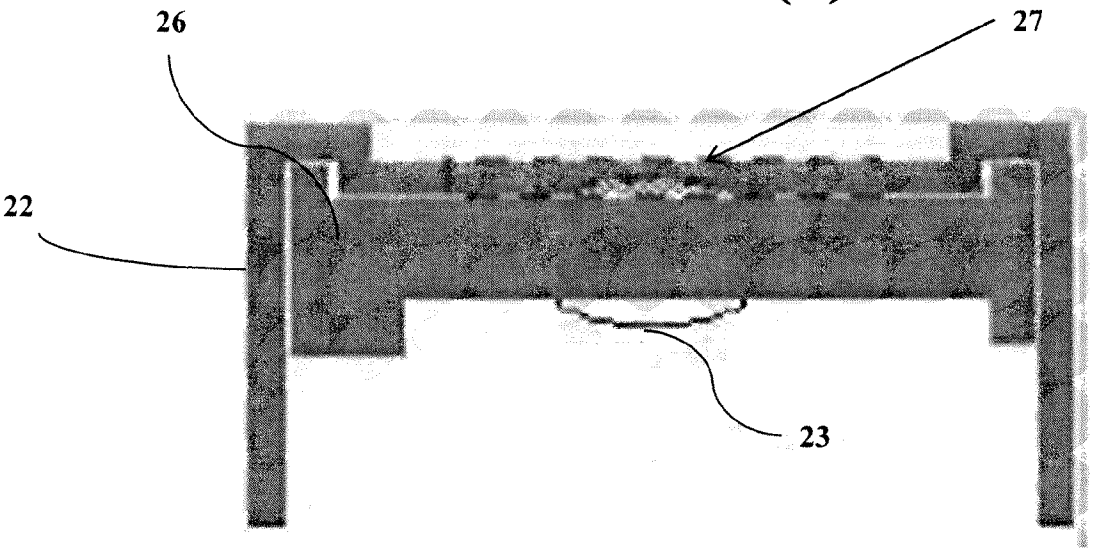
Figure 2B:
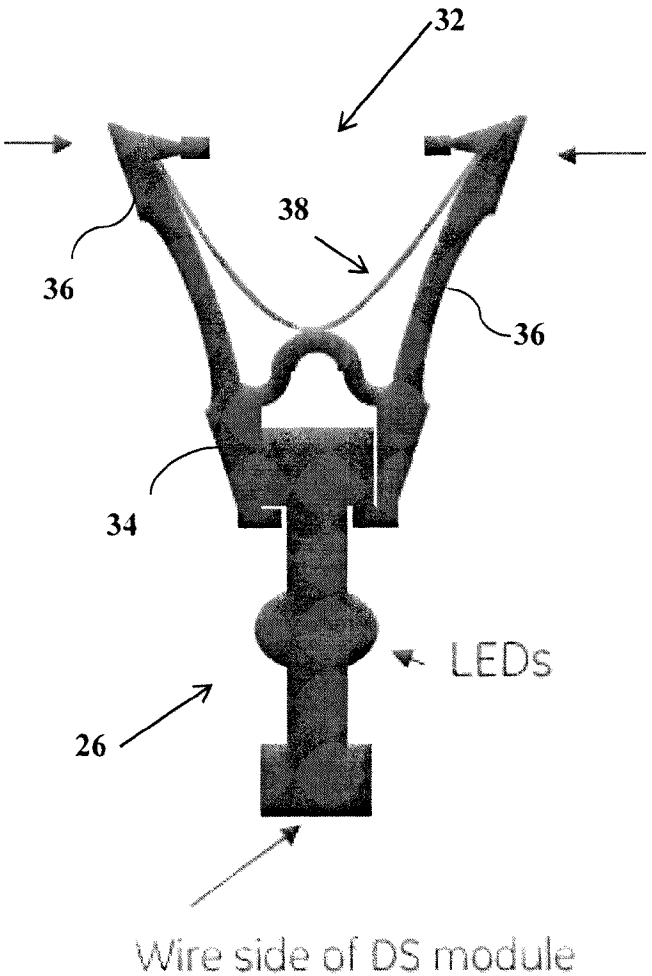
FIGS. 2(*a*) and (*b*) illustrate exemplary strip clips in a closed and open position for use with an LED module according to another aspect of the present disclosure.
Figure 2A:
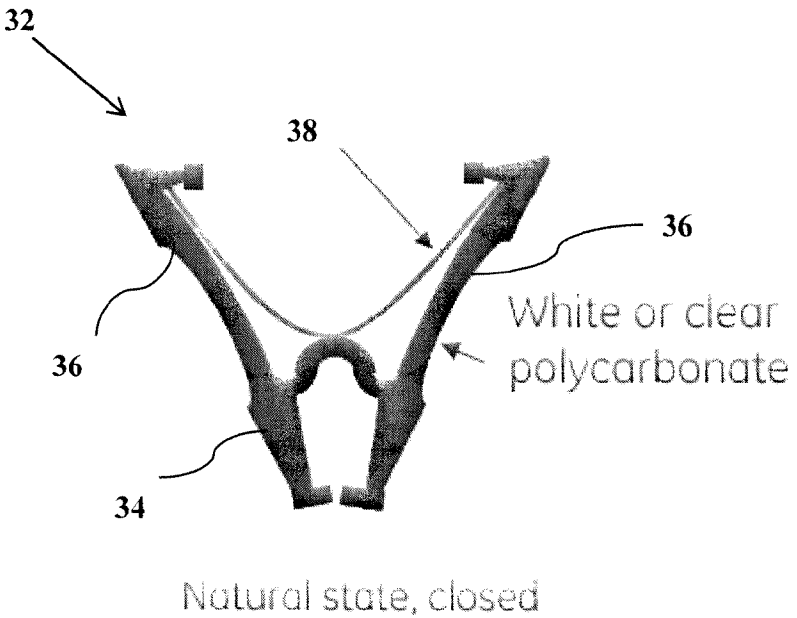
Figure 2C:
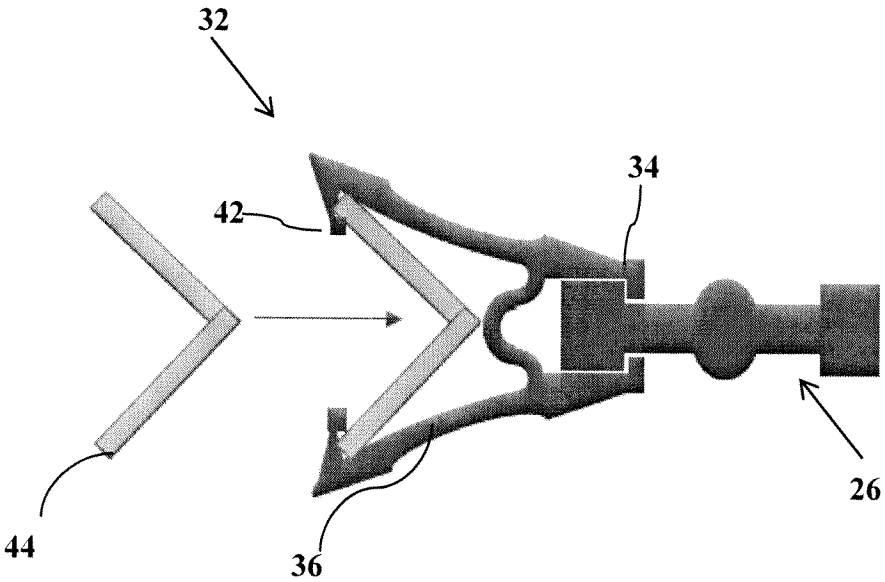
Figure 2D:
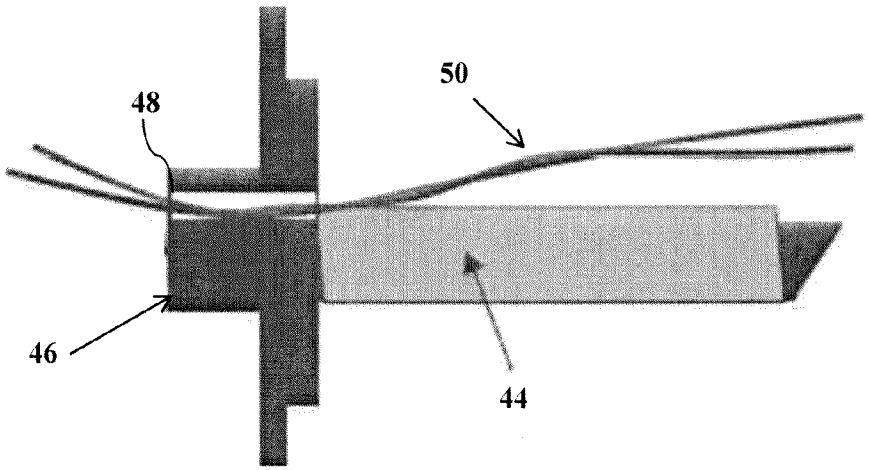
Figure 2E:
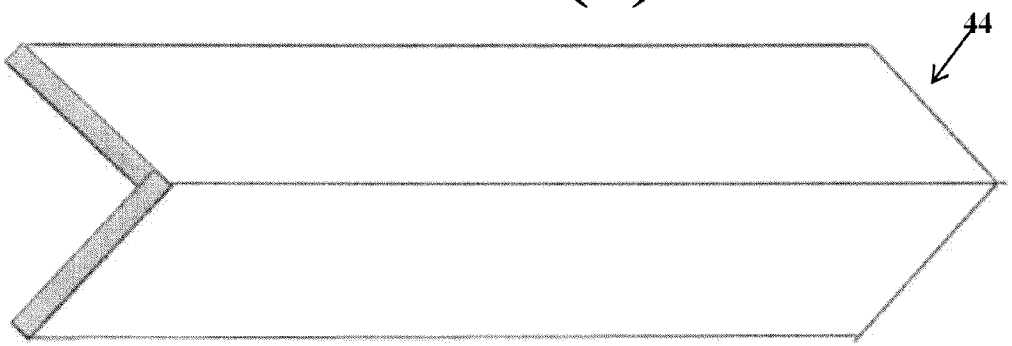
Figure 2F:
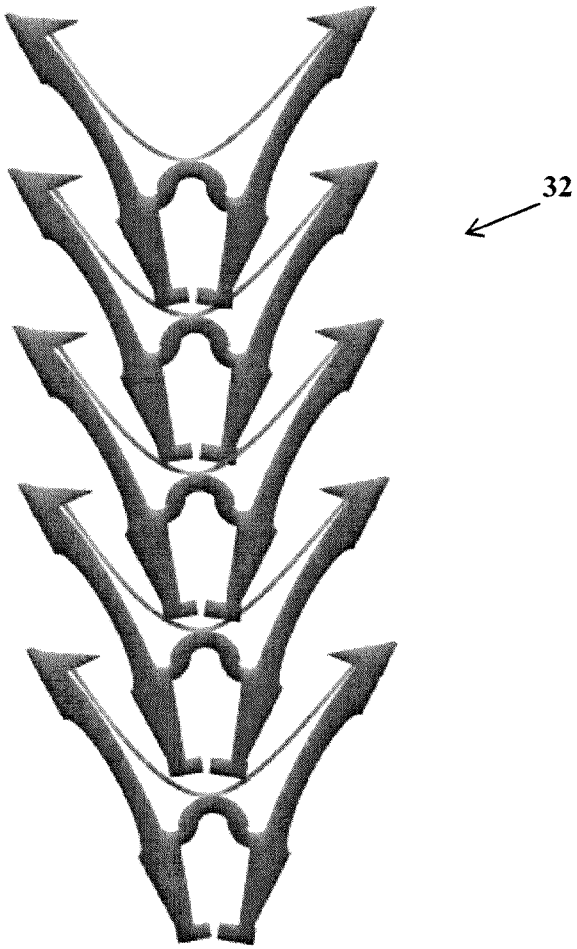
Figure 3A:
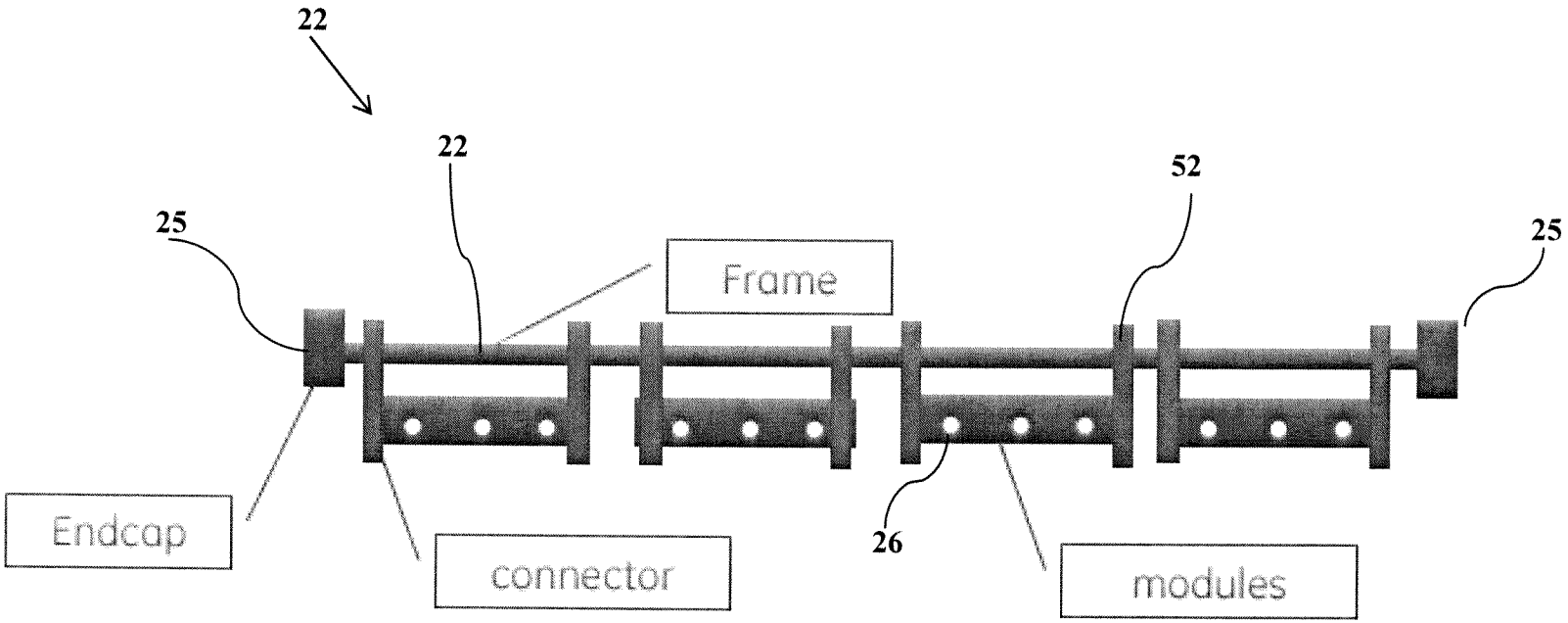
FIGS. 3(*a*)-(*c*) illustrate another exemplary mounting arrangement having a frame and connectors for mounting LED modules, in accordance with yet another aspect of the present disclosure.
Figure 3C:
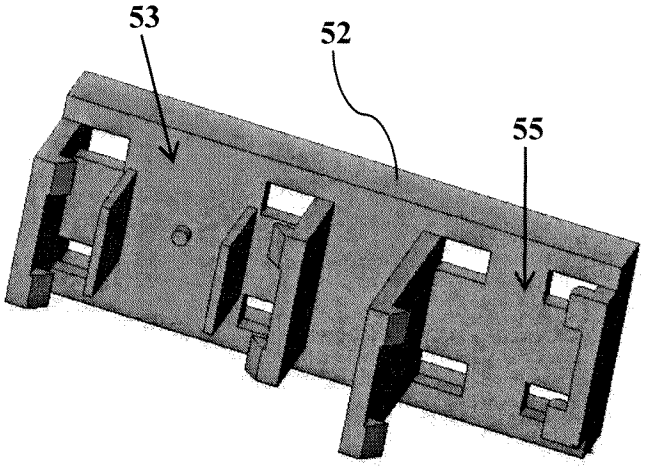
Figure 3B:
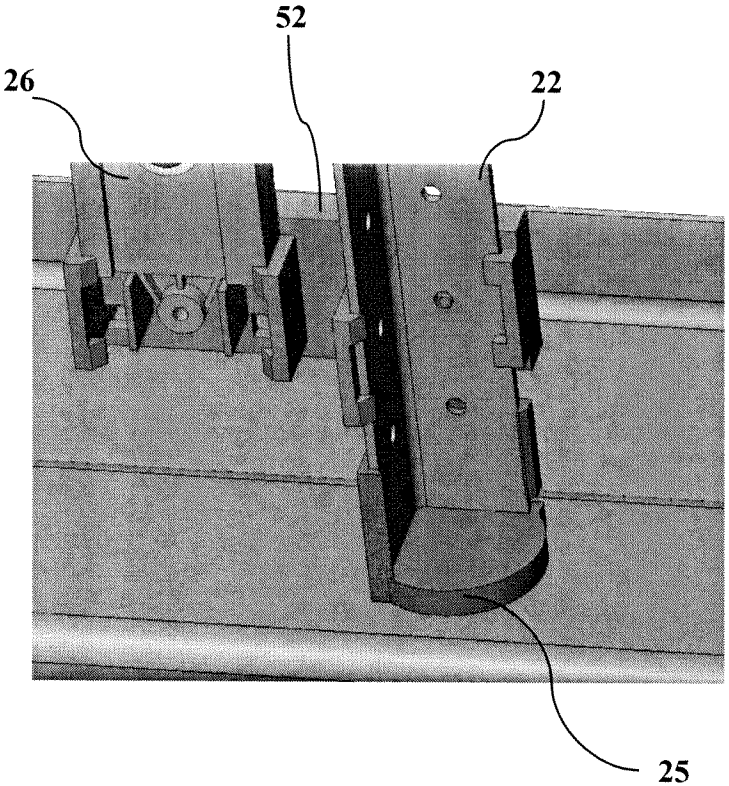
Figure 3E:
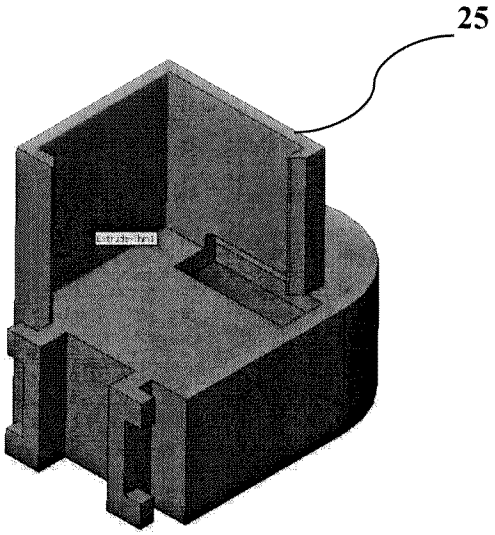
Figure 3D:
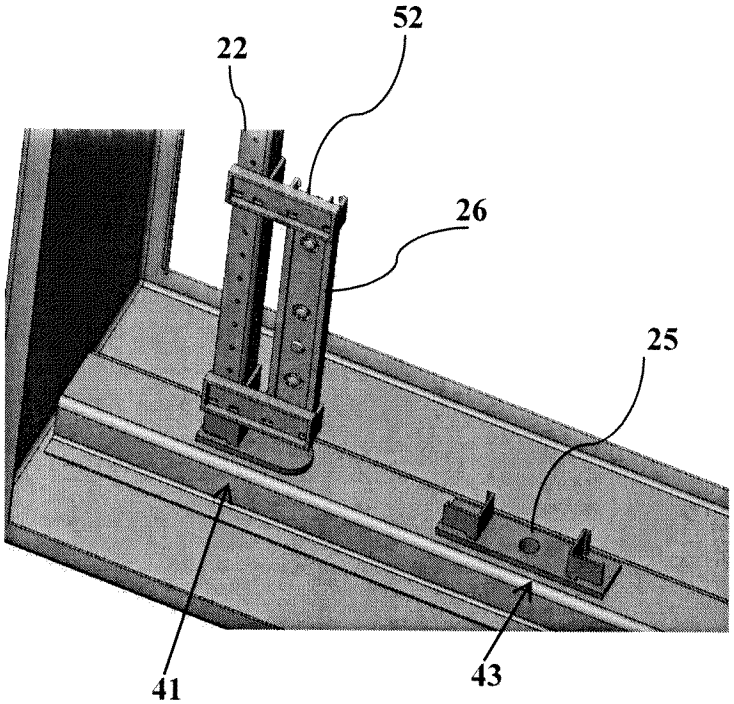

Embodiments of the subject application are directed to mounting arrangements used to replace linear fluorescent lamps with current LED powerstrip modules ("LED modules") in various applications. Although this description describes the mounting arrangements in terms of cabinet signs, the present mounting arrangements are also amenable to other applications, including outdoor awnings, cabinet signs, particularly double-sided box signs, and other like applications originally built for use with fluorescent lights. The designs are easy to assemble with minimal parts and stock-keeping units. The mounting arrangements are simple to adjust for uniformity after installation, simple maintenance, and easy wiring access.

FIG. 1(*a*)-(*d*) illustrates one exemplary aspect of mounting arrangements 20 according to the present disclosure. The mounting arrangements 20 are configured to hold and secure LED modules 26. The LED modules for the backlighting system can take many different configurations. Each LED module 26 generally includes a plurality of LEDs 23 that are mounted on a printed circuit board (not shown) having printed circuitry. A housing 29 covers the printed circuit board, the circuitry and, if desired, some of the LED 23.

The LED modules 26 can be formed in a thin elongate rectangular parallelepiped shape having two larger planar surfaces, e.g. front and rear, that have a greater surface area as compared to the remainder of the surfaces that define the rectangular parallelepiped LED module, although the LED module can take many alternative configurations.

The LEDs 23 can comprise any conventional LED. The LEDs 23 may be provided on two sides, e.g. front and rear, of the LED module 26 where some of the LEDs 23 face in one direction and some of the LEDs 23 face in an opposite direction. In other words, a plurality of LEDs face forward to illuminate in a forward direction and a plurality of LEDs face rearward to illuminate in a rear direction. The printed circuit board (or similar device for conveying electrical power to the LEDs) can be a double-sided printed circuit board having LEDs 23 positioned on a first (forward) surface and a second (rearward) surface.

The LEDs 23 on the forward side of the printed circuit board can be aligned with the LEDs on the rearward side, e.g. a line normal to the printed circuit board and going through an LED on the front side of the board also goes through an LED on the rear side of the board. Alternatively, the LEDs on the forward side of the LED modules 26 can be offset or staggered from the LEDs on the rearward side of the LED modules 26. The LEDs 23 used can also be a grouping of multicolor LEDs such as red/green/blue to create multiple color effects or a specific backlighting color quality for the cabinet sign. Controls can also be internal to the modules 26 to change colors as desired by the sign owner for ambient conditions or time of day or as a signal to viewers. Also, controllers can be used to dim the sign as desired in relation to ambient brightness to further conserve energy, something that is very difficult to accomplish with fluorescent lamps. The LEDs used can be used in conjunction with phosphor material present on or in the sign panel to create specific colors on the face of the sign.

The housing 29 protects the circuitry as well as the LEDs 23. The housing 29 can encapsulate the printed circuit board. Openings 21 in the housing may be provided for the LEDs 23 and may comprise a funnel or conic shape to provide a reflective surface for the LEDs. The material from which the housing is made can be a reflective material. The reflective material near the LED 23 can also be a separate reflector built into the design or a combination of reflector and optic to preferentially spread the light from the LED source to increase beam spread and improve panel illumination uniformity with fewer sources. Also, lenses can be placed over top of the LEDs to change the optical pattern for a broader overlap.

The present mounting arrangements 20 comprise one or more support frames 22 that are capable of snapping into holding bases attached to raceway structures already present in a sign. The mounting arrangements 20 are designed such that they will not bend over the length to provide rigidity for mounting the LED modules 26. Typically, after removal of existing fluorescent sockets, signs are left with holes that the present mounting structures can utilize for simple retrofit applications.

The frames 22 may be cut to any length desired for a particular application, preferably having a maximum length of about 8', and configured to snap into the holding bases 25 at both ends. To tolerate the length of the frames, the holding bases 25 are preferably configured to be taller than average bases and the frames snap into the base rather than being inserted. The frame 22 preferably comprises a light material that does not rust, such as aluminum; however, various other materials may alternatively be used. Further, the frame should be anodized to prevent shorting. Additionally, the holding bases 25 have thru-cut holes 24 for wires to pass, such that the wires are not damaged when pushing the frame 22 into the base 25.

To mount the frames 22 to the holding bases 25, the frames 22 may comprise any mounting arrangement known in the art, such as tombstone or socket style compatible, or a mixture of the two. Generally the frames comprise lengths of about 8' or less. If longer lengths are necessary, connectors may be implemented for combining frames of various lengths together to create composite frames longer than 8', such as butt-connectors, etc. For example, a 2' frame and an 8' frame may be connected to get an overall 10' length frame. The holding bases 25 are provided with mounting holes for screwing the bases into the existing sign bulkhead or raceway structures.

The frames may additionally include counting holes or another ruler method for the conversion of cut points that an installer may use without having to measure for the replacement of standard fluorescent lamps. Therefore, a sign may not have to be measured if it is known what type of fluorescent lamp is used in the sign to begin with. Table 1 provides an example of a chart that would provide a layout of each scenario to be created for quick reference, which would at least reduce, and eventually eliminate the need to measure a sign each time a lamp is intended to be replaced.

TABLE 1

| Standard Size FLU | Lamp Description | ANSI lamp length | Number of notches or holes to leave for cut-length | Typical number of DS modules |
|---|---|---|---|---|
| 18 inch | F18 | TBD (usually 1.5 to 2" less than standard) | By Calc | 1 |
| 24 inch | F24 | | | 2 |
| 30 inch | F30 | | | 2-3 |
| 36 inch | F36 | | | 3 |
| 48 inch | F48 | | | 4 |
| 60 inch | F60 | | | 5 |
| 64 inch | F64 | | | 5-6 |
| 72 inch | F72 | | | 6 |
| 84 inch | F84 | | | 7 |
| 96 inch | F96 | | | 8 |

FIGS. 1(*a*) and (*b*) illustrate mounting arrangements 20 that include a frame 22 having a LED module 26 mounted thereon. The frame 22 consists of a back portion 31 and two side portions 33 extending perpendicularly from the back portion. The LED module 26 may be placed on the back portion of the frame, such that the two sides extend along the side of the module 26. The back portion of the frame preferably includes openings 27 spaced out along its length to allow for light from the LEDs 23 to pass through the frame 22 regardless of where the power strip LED modules 26 are attached along the frame 22. The openings 27 are preferably located a minimum distance from the edge of the LEDs 23, so as not to cause incidental blockage.

To secure the LED module 26 to the frame 22, spring-clips 28 may be provided that snap onto both side portions of the frame 22 at each end of the module 26 to secure the module 26 in place on the frame. As best shown in FIG. 1(*c*), the clips preferably comprise a general "U" shape; however, the clips 28 may take on any of a variety of configurations. The spring clips 28 according to the subject embodiment are shorter than traditional clips 30 to enable LED modules 26 to be spaced closer together on a frame 22, if necessary. The shortening of the clips may be accomplished by creating a bulge in each side of the clip, such that there remains flex for the clips, but the modules 26 can move one notch closer. Also, since the holding bases 25 are taller than average, the shorter snap-clips are more able to overlap the base when modules are located close to the base. Preferably, the clips 28 comprise white polycarbonate; however, other thermoplastic polymer material may additionally be acceptable. The clips are provided with a means for routing the wires from module to module and may assist with wire management as well.

FIG. 1(*d*) illustrates a cross-sectional side view of the module 26 secured inside a frame 22. As shown in the Figure, the LEDs 23 extends through both sides of the module 26. Accordingly, the openings 27 in the frame are aligned with the LEDs, so that the frame 22 does not contribute to any potential light blockage.

FIGS. 2(*a*)-(*f*) illustrate another exemplary mounting arrangement for attaching an LED module 26 to a frame 22 of a sign application. The mounting support 20 includes strip clips 32 for providing a simple method for mounting LED modules 26 to existing sign structures. Strip clips 32 include a front end comprising jaws 34 that open and close according to pressure applied to the back end of the strip clip. The back end includes radial arms 36 that act as levers, such that squeezing the arms together opens the jaws 34 wider to permit the insertion of one end of an LED module 26. FIG. 2(*a*) illustrates the strip clip 32 in a natural, closed state, while FIG. 2(*b*) depicts an open state, with the radial arms 36 being squeezed together to open the jaws 34. When the jaws 34 are opened, an LED module 26 may be inserted into the jaws 34 and secured in the clip 32 by causing the jaws 34 to close (releasing pressure on the radial aims). The end of the LED module 26 inserted into the clip 32 is the end opposite to the end including wires. The strip clips 32 are preferably equipped with a steel spring portion 38 that extends in a general U-shape between the two radial arms to keep the arms open and the jaws 34 closed, which is the natural state of the clips (FIG. 2(*b*)). The steel spring portion 38 does not need to extend the full length of the aims 36, but rather only needs to comprise a small section that is inserted along the length.

As best illustrated in FIG. 2(*c*), the radial arms 36 are configured to provide simple mounting of a clipped-in module 26 to a socket 40, by means of a simple, folded piece of plastic 44 that is long enough for several inches of overlap, preferably from about 4 to 6 inches. The folded piece of plastic 44 is sized to snap into existing HO socket size holes. HO socket holes comprise the holes in existing fluorescent sockets in box signs. The arms 36 of the clip 32 preferably include hooks 42 at each tip, such that the folded piece of plastic 44 snaps into the hooks 42 with an interference fit. The strip clips 32 hold the LED modules 26 slightly offset from the center line of the base to get LEDs 23 close to the centerline. Standard sockets can be replaced with dummy sockets 46 that have the same geometry as the back of a standard socket and includes a channel 48 for wires 50 to pass (FIG. 2(*d*)). The strip clip configuration includes the further advantage of nesting within shipping boxes for easy, convenient shipping, as illustrated in FIG. 2(*f*).

FIG. 3(*a*) illustrates another aspect of a mounting arrangement 20, whereby a frame 22 is provided with at least two separate connectors 52 that mount the LED modules 26 offset from, but parallel to the frame 22. Similar to the arrangements described above, the frame 22 includes two holding bases 25 for mounting to a bulkhead or raceway in a sign structure. Each module 26 is mounted to the frame 22 by two connectors 52, one at each end of the module. One end of the connector 52 attaches to the module 26 and the other end connects to the frame 22.

As illustrated in FIG. 3(*b*), the modules are preferably configured to attach to a connector 52 by one of a snap-fit, interference-fit, transition-fit, and the like. The frame also attaches to the connectors by sliding into a complementary holding portion, such that the connector may be slid along the frame as needed to properly align the modules 26. FIG. 3(*c*) best illustrates one exemplary connector 52 comprising a module attachment portion 53 and frame attachment portion 55.

FIG. 3(*d*) illustrates an LED module attached to frame 22 by means of two connectors 52, one at each end of the module 26. The frame 22 is then secured to the existing raceway of a sign (not shown). The holding bases may comprise a variety of sized and shapes, depending on the specific structure and number of frames incorporated. FIG. 3(*d*) illustrates two varieties of bases 25, the base on the left 41 being meant for a single frame configuration and the base on the right 43 allowing for two frames to be attached. FIG. 3(*e*) illustrates a third variety, wherein the base is taller and narrower than either of the bases previously described. The particular structure of the base 25 may be selected on a case by case basis.

Figure 4A:
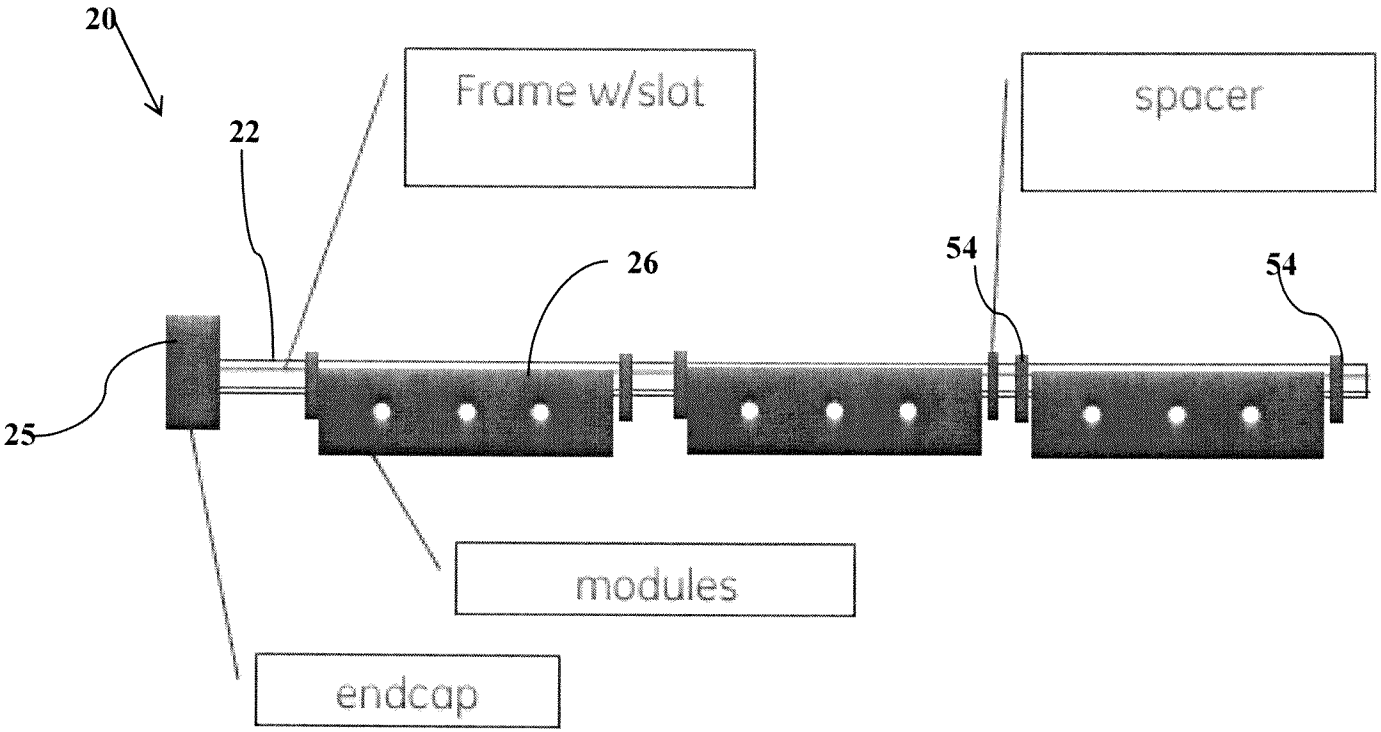
FIGS. 4(*a*)-(*c*) illustrate an exemplary mounting arrangement having a frame and spaces for mounting LED modules, in accordance with another aspect of the present disclosure.
Figure 4C:
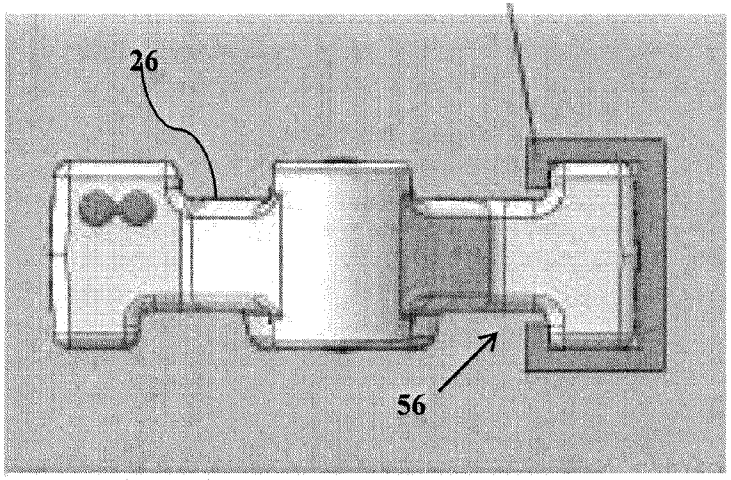
Figure 4B:
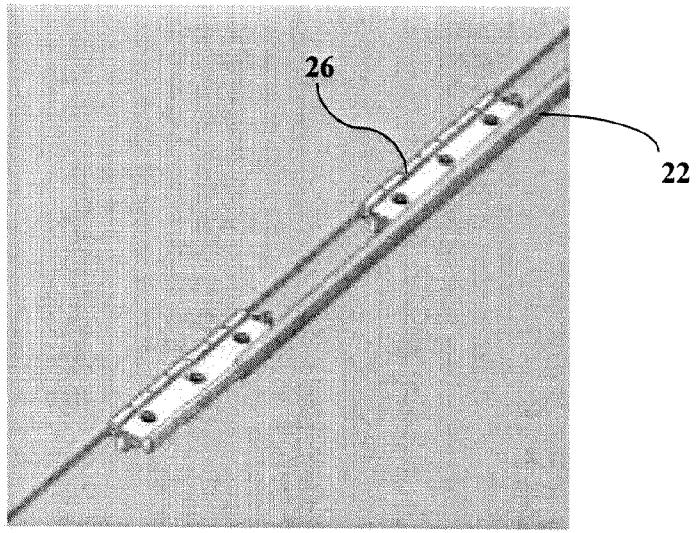

In accordance with another exemplary mounting arrangement 20, as best illustrated in FIGS. 4(*a*)-(*c*), a frame 22 is provided with a generally c-shaped slot configured to receive one end of a LED module 26. According to this arrangement, the LED modules 26 are mounted directly onto a frame 22, and multiple modules are separated by spacers 54. The modules may be attached to the frame, such that the module is able to slide along the frame, or the module may be secured statically in one place. Each module 26 is flanked on each end by a spacer 54. The spacers ensure a required distance is maintained between the modules and prevent the modules from experiencing undesired sliding in the slot.

FIGS. 5(*a*)-(*c*) illustrate another exemplary mounting arrangement 20, wherein the modules 26 are equipped with one or more screw tabs 58 along the length of at least one side of the module 26 for providing more flexible mounting options. The screw tabs 58 are preferably flush with the edge of the module 26, such that the tabs do not extend past the edge of the module to a great degree. As best illustrated in FIG. 5(*a*), the frame 22 includes a screw slot feature 60 that is configured to accept the one or more screws (not shown) that extend through the screw tabs 58. Providing a screw slot is beneficial for eliminating the need for a drilled hole. The screws 58 may be slide-mounted to the frame, such that the module can be slid up and down the frame, or the screw may be statically held in one position of the frame. Multiple modules may be mounted on a single frame and spaced apart to provide uniform lighting along an entire sign. Additionally, a module may include one or more screw tabs 58 along the opposite side of the module, such that the module may be mounted to two parallel frames (not shown), rather than to a single frame. As illustrated in FIGS. 5(*b*) and (*c*), an L-bracket 72 may be secured to the frame 22 to mount the frame inside a box sign, or other application.

Figure 6B:
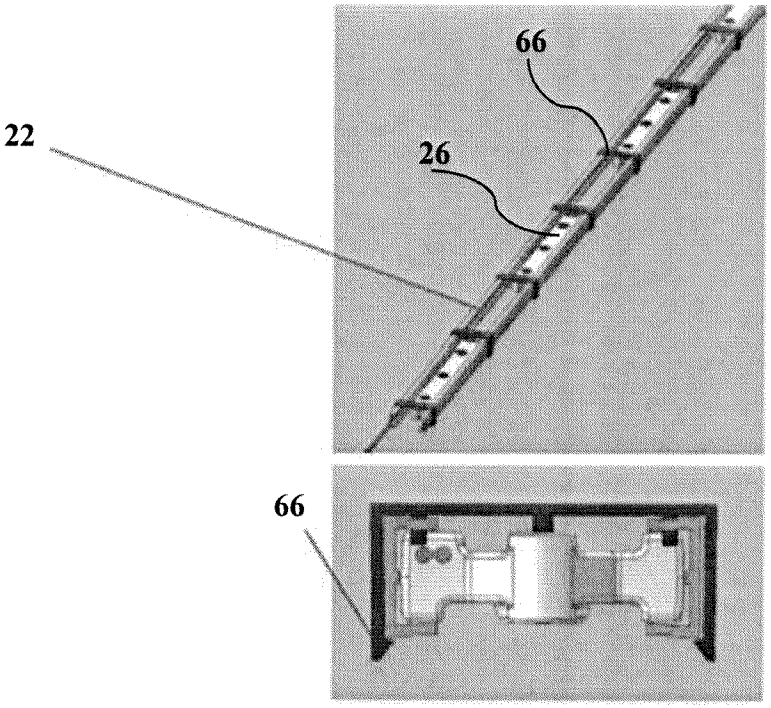
FIGS. 6(*a*)-(*b*) illustrate an exemplary mounting arrangement having two frames, in accordance with yet another aspect of the present disclosure.
Figure 6A:
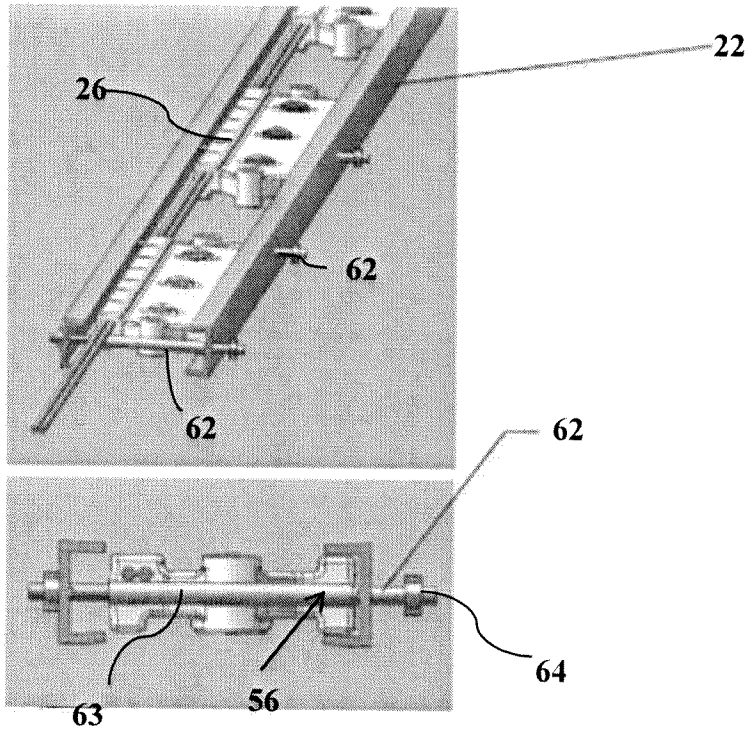

FIGS. 6(*a*) and (*b*) illustrate alternative or additional mounting arrangements that incorporate the use of two parallel frames 22, with one or more LED modules 26 secured in between each frame 22. Each frame 22 includes a generally c-shaped slot 56, for receiving a side portion of a module 26. In the configuration depicted in FIG. 6(*a*), the modules 26 are slid into the c-shaped slots 56 of the frames 22 and are further secured in place by a plurality of links 62. The links 62 comprise a rod 63 that extends through each frame 22 and is held in place by retainers 64. The links are preferably secured at both the front end and the rear end of each module 26, to ensure that the module is secure and does not slide along the frames 22. Alternatively, or in addition to the links 62, the modules 26 may be secured in place by a plurality of ties 66 that extend over the module and each frame 22 that secure the module, and hook onto an underside portion of each frame, as illustrated in FIG. 6(*b*). The plurality of ties 66 secures the modules 26 in place by squeezing the frames 22 toward the modules 26. Preferably, each module is secured by two ties 66, one at each end of the module.

Figure 7A:
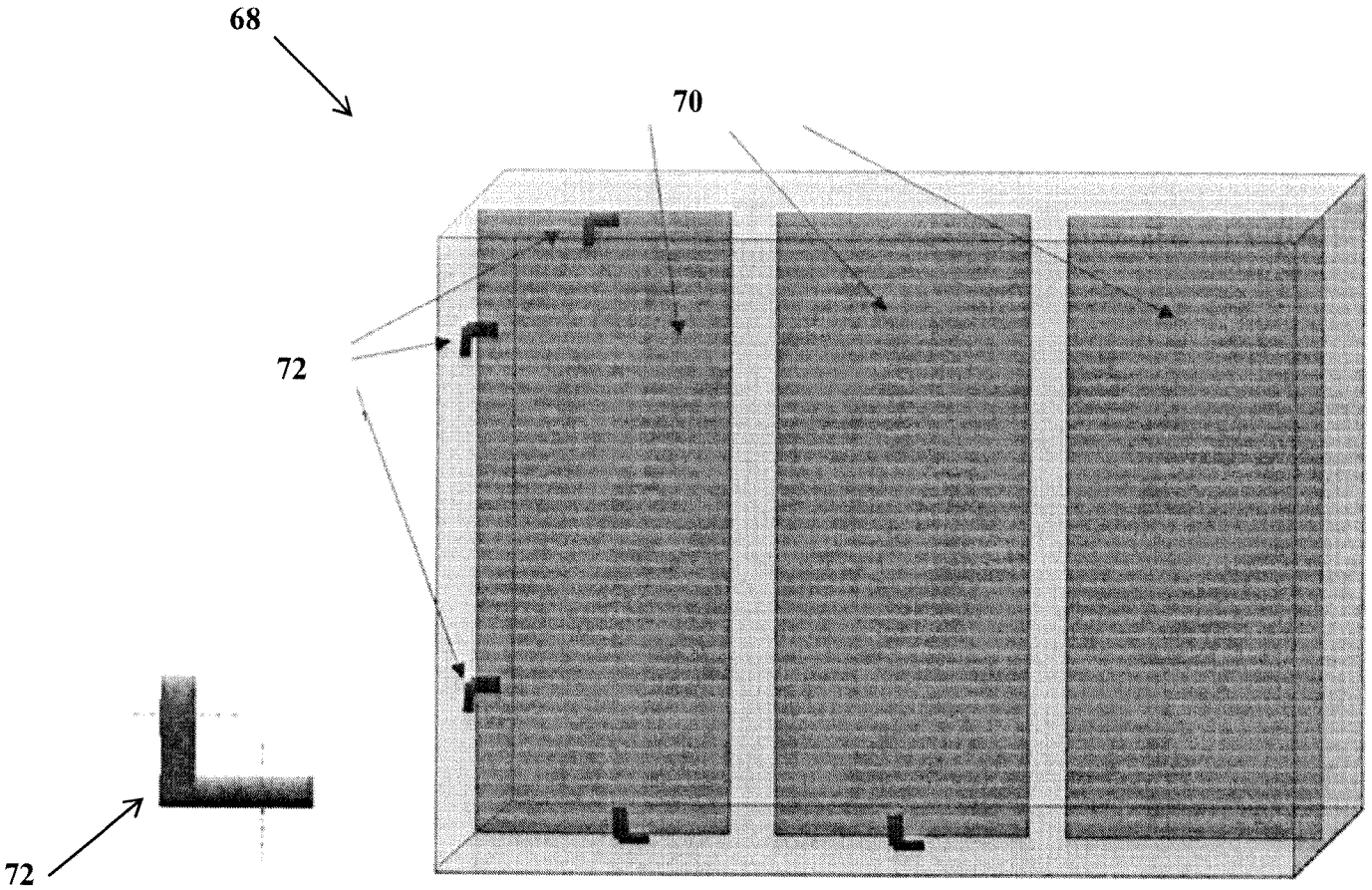
FIGS. 7(*a*)-(*c*) illustrate an exemplary mounting template including a pattern for mounting LED modules without a tube, in accordance with yet another example of the present disclosure.
Figure 7B:
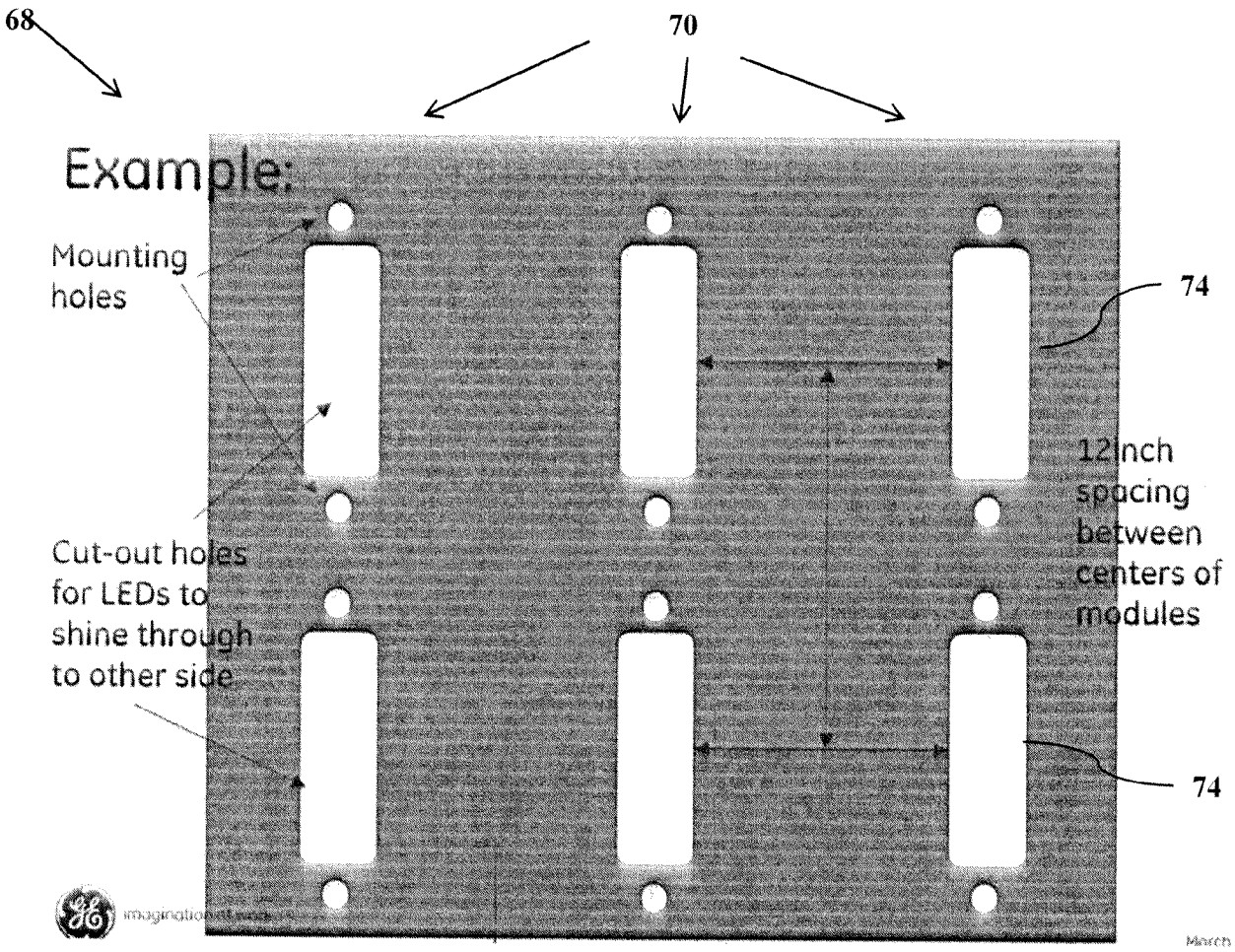
Figure 7C:
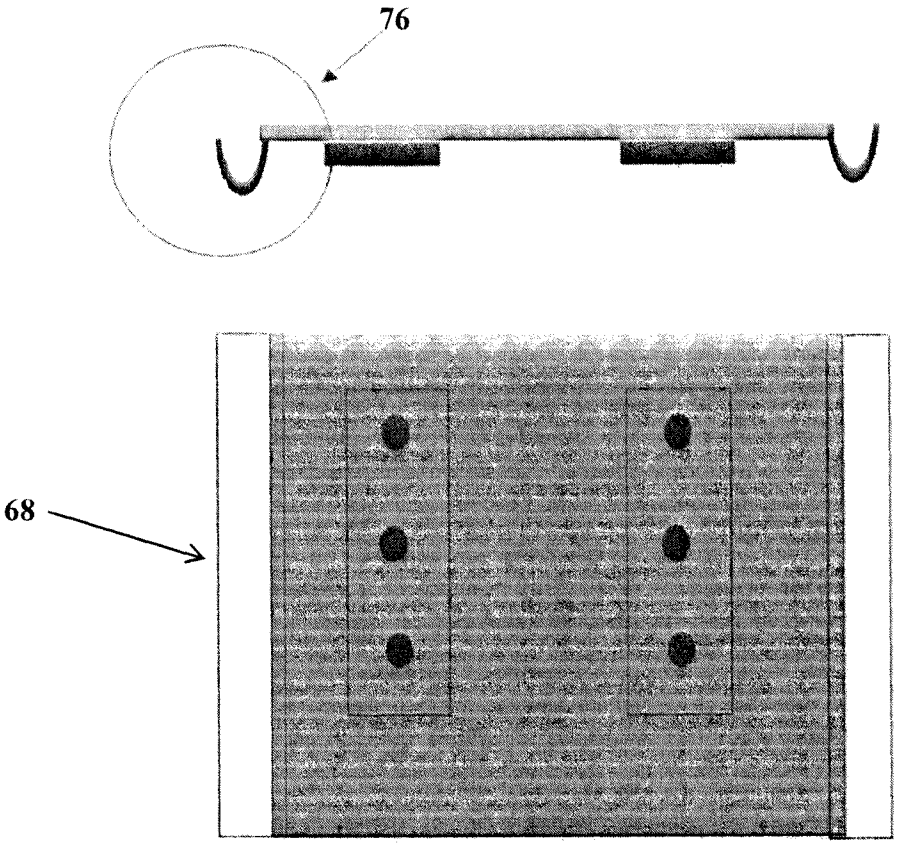

In accordance with another aspect of the present mounting arrangement, a mounting template 68 is provided by creating a pattern that can be cut into a flat panel for mounting LED modules in a cabinet sign without a tube. Typically, a double-sided LED module is about 9-10"×1-2", more preferably, about 9.16"×1.15"; however, the dimensions of the module may vary according to the desired application. The patterns are fowled in panels of clear plastic, aluminum, or other like material. The clear panels 70 include brackets 72 that are about 90° for mounting and securing the panels to the sides of a sign, as shown in FIG. 7(*a*). As further illustrated in FIG. 7(*b*), each panel 70 has a cut-out pattern 74 that can be program cut with a computer numerical control router, or other like machine, and laid out as determined by the size of the sign to be lit. The cut-out holes allow for LEDs to shine through to the other side and prevents undesirable light blockage. The modules should be spaced an appropriate distance from the other modules on a panel. Preferably, the modules are distanced such that there is an about 12 in spacing between the center of the modules. (See FIG. 7(*b*)). Once a drawing of a pattern is created, the sign may be cut easily by the OEMs. Alternatively, the panels may come in standard sizes, such as about 2'×8' with a power supply mounted, or 4'×4' with a power supply mounted. Additionally, the panels may be customized to include bended edges 76 to create extra strength if desired (FIG. 7(*c*)). The bended edges cause the panel to become more rigid and stronger overall.

Figure 8B:
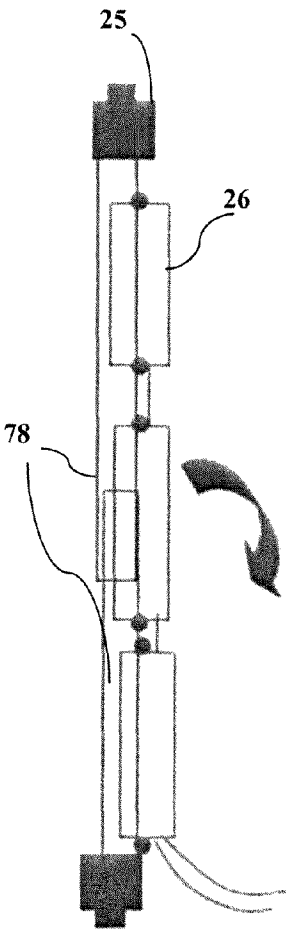
FIGS. 8(*a*)-(*b*) illustrate an exemplary mounting arrangement including adjustable frames for mounting LED modules, in accordance with yet another aspect of the present disclosure.
Figure 8A:
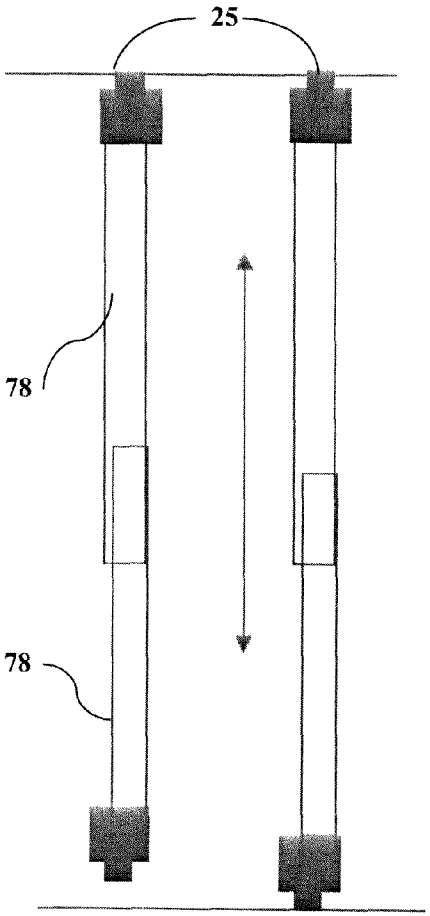

FIGS. 8(*a*) and (*b*) illustrate a further exemplary mounting arrangement, wherein the frame 22 consists of one or more stamped and bent metal units 78 designed to be added together to approximate a desired frame length, and then expand or contract as needed to hold the frame in place between holding bases 25. The holding bases 25 are dummy bases and are provided for structural purposes only and have no electricity. Features are then stamped into the metal units 78 to slide in modules and hold the modules in place. Separate connection to low voltage wires would be needed for this configuration.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A mounting arrangement for use with an LED power strip module including:

one or more frames, each frame having a first end and a second end;

a first holding base configured to mate with said first end and a second holding base configured to mate with said second end; and at least one LED module having a first and second edge and two elongated side edges, said module comprising a plurality of LEDs and adapted to removably attach to said one or more frames, wherein said first and second holding bases are adapted to secure said one or more frames to a signage structure.

2. The mounting arrangement of claim 1, wherein said the LED power strip module is configured for mounting in cabinet signs.

3. The mounting arrangement of claim 1, wherein said frame comprises aluminum.

4. The mounting arrangement of claim 1, wherein said frame is anodized.

5. The mounting arrangement of claim 1, wherein said LED power strip module is a double-sided module.

6. The mounting arrangement of claim 5, wherein said one or more frames comprise openings spaced along the length of the frame configured to permit light from the LEDs to pass through the frame.

7. The mounting arrangement of claim 1, further including a first spring-clip configured to snap into said one or more frames at said first edge and a second spring-clip configured to snap into said frame at said second edge, said first and second spring-clip adapted to secure the at least one LED power strip module to said frame.

8. The mounting arrangement of claim 1, further including at least two connectors configured to attach to said LED power strip module at each of said first and second edge and mount said LED module to said frame in a parallel configuration.

9. The mounting arrangement of claim 1, wherein said one or more frames includes a generally c-shaped slot configured to receive the first side edge of said LED power strip module.

10. The mounting arrangement of claim 9, further including a plurality of spacers separating said LED power strip module.

11. The mounting arrangement of claim 9, wherein said arrangement comprises two frames having the generally c-shaped slot, wherein the second frame is configured to receive the second side edge of said LED module.

12. The mounting arrangement of claim 11, further including a first and second link mounted at both the first and second edge of the LED power strip module and extended through each frame, securing said LED power strip module in place.

13. The mounting arrangement of claim 11, further including a plurality of ties configured to extend over the LED power strip module and hook onto an underside portion of each frame.

14. The mounting arrangement of claim 13, wherein said ties are further configured to squeeze the frames toward the LED power strip modules, securing the LED power strip module to the frame.

15. The mounting arrangement of claim 1, wherein said LED power strip modules include or more screw tabs along at least one side edge of said LED power strip module.

16. The mounting arrangement of claim 15, wherein said screw tabs are configured to mate with a screw slot feature provided on said one or more frames, securing said LED power strip module to said frame.

17. The mounting arrangement of claim 16, wherein said first and second holding bases comprise L-brackets.

18. The mounting arrangement of claim 1, wherein said frame comprises one or more stamped and bent metal units configured to expand or contract to lengthen or shorten said frame.

19. An LED module comprising:

a housing having a first side edge and a second side edge;

a plurality of LEDs mounted on a printed circuit board; and a mounting arrangement, said mounting arrangement comprising:

at least one frame, said frame having a first end and a second end, said frame being adapted to removably accept said LED module;

a first holding base configured to mate with said first end; and a second holding base configured to mate with said second end, wherein said first and second holding bases are adapted to secure said one or more frames to a signage structure.

20. The LED module according to claim 19, wherein said module is a double-sided LED module.

21. The LED module according to claim 19, wherein said LED module includes or more screw tabs along at least one side edge of said LED module.

22. The LED module according to claim 21, wherein said screw tabs are configured to mate with a screw slot feature provided on said at least one frame, securing said LED module to said frame.

23. The LED module according to claim 19, wherein said first and second holding bases comprise L-brackets.

24. A mounting arrangement for mounting a double-sided LED module to a signage application, said arrangement including:

one or more transparent flat panels comprising a cut-out pattern;

a plurality of brackets configured to secure said panels to said signage application having at least two sides; and at least one double-sided LED module configured to be mounted to said flat panels, wherein said cut-out pattern is configured to allow said LEDs to illuminate each side of said signage application without light blockage.

25. A double-sided LED module for mounting to a sign application, said double-sided LED module comprising:

a housing having a first elongated side edge and a second elongated side edge; and at least one LED mounted on each side of a printed circuit board, wherein said double-sided LED module further includes a mounting arrangement comprising:

one or more transparent flat panels having a cut-out pattern; and a plurality of brackets configured to secure said panels to said signage application having at least two sides, wherein said double-sided LED module is configured to be mounted to said flat panels and wherein said cut out pattern is configured to allow said at least one LED to illuminate each side of said signage application without light blockage.

26. A mounting arrangement for mounting an LED module to sign assembly; said arrangement including:

an LED module comprising one or more LEDs positioned on a printed circuit board;

a strip clip comprising a front end having jaws configured to open and close, and a back end having radial arms, wherein upon pressure to the aims, said jaws are configured to open and receive said LED module;

a folded piece of plastic configured to snap into hooks located on said aims; and a socket capable of receiving said folded piece of plastic.

27. The mounting arrangement of claim 24, wherein said strip clips are designed to hold said LED module offset from the center line of the assembly.

28. The mounting arrangement of claim 24, wherein said socket is a dummy socket.

* * * * *